US006679218B2

(12) United States Patent
Kragner et al.

(10) Patent No.: US 6,679,218 B2
(45) Date of Patent: Jan. 20, 2004

(54) STARTING DEVICE

(75) Inventors: Marcus Kragner, Huskvarna (SE); Anna Sjögren, Jönköping (SE)

(73) Assignee: Aktiebolaget Electrolux, Stockholm (SE)

( * ) Notice: Subject to any disclaimer, the term of this patent is extended or adjusted under 35 U.S.C. 154(b) by 63 days.

(21) Appl. No.: 10/140,695

(22) Filed: May 8, 2002

(65) Prior Publication Data

US 2002/0166533 A1 Nov. 14, 2002

(30) Foreign Application Priority Data

May 11, 2001 (SE) ..... 0101665

(51) Int. Cl.[7] ..... F02N 1/00
(52) U.S. Cl. ..... 123/185.3; 123/184.4
(58) Field of Search ..... 123/185.3, 185.4

(56) References Cited

U.S. PATENT DOCUMENTS 4,615,311 A * 10/1986 Scheckel ..... 123/185.3
5,361,738 A * 11/1994 Iida ..... 123/185.4
2003/0140884 A1 * 7/2003 Matsubayashi et al. .. 123/185.3

* cited by examiner

*Primary Examiner*—Thomas N. Moulis
(74) *Attorney, Agent, or Firm*—Pearne & Gordon LLP

(57) ABSTRACT

Conventional leaf blowers that are carried on the back of the operator have a starting device placed outside an engine and an fan which means that there position will be far from the back of the operator. This position of the starting device makes it difficult for the operator to reach it and results in that the center of gravity for the tool will be far from the back of the operator. The position also means that the operator must take the tool down from the back to be able to start the tool. In this application is a new arrangement that solves the above-described problem claimed. This is done by placing the starting device (20) for the engine (11) on the side of the fan that is facing towards the back of the operator when the leaf blower is in its right position on the back of the operator. This moves the center of gravity closer to the back of the operator and makes it possible for the operator to reach the starting device without removing the tool from the back.

7 Claims, 3 Drawing Sheets

STARTING DEVICE

Figure 1:
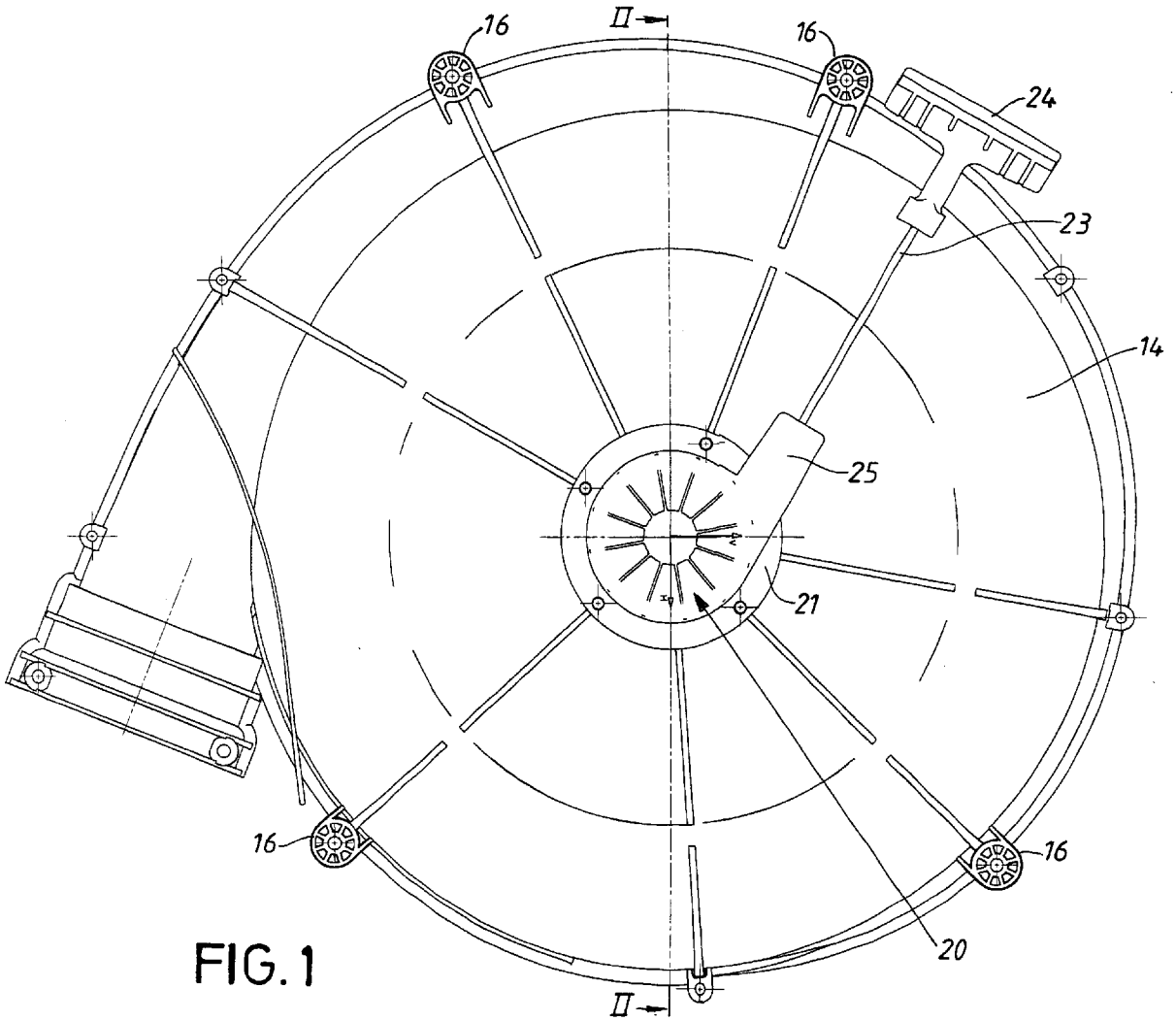

Combustion engine powered leaf blowers are used more and more for different kinds of work. The numbers of areas where leaf blowers are used is increasing and the leaf blowers are replacing traditional brooms. Leaf blowers are an effective and time saving tool for cleaning of large areas like for example parking places, pavements, lawns and footpaths.

Leaf blowers makes it possible to clean large areas in an easy way. During cleaning of areas with conventional equipment will parked cars on a parking place make it necessary to parts of the area uncleaned. If the same area is cleaned with a leaf blower is it possible to blow away the rubbish underneath the parked cars, which will increase the efficiency, save time and improve the result.

Even though the leaf blower is an effective tool that helps the operator to clean large areas will the operator work long shifts carrying the leaf blower on the back. Leaf blowers available on the market today are large and heavy with the centre of gravity for the tool placed at a long distance from the back of the operator. This will expose the operator for high loads when the leaf blower is carried on the back of the operator. This type of tools is also generating a lot of noise, which will make it very tiring for the operator as well as for other persons located close to the tool.

The weight of the leaf blower is not the only parameter that effects the working conditions for the operator. The centre of gravity for the tool is another parameter that will effect the operator as well as the design of the tool and the different controls, like for example start and stop of the engine, that the operator use for controlling the tool.

Conventional leaf blowers have a fan with a fan wheel placed towards the back of the operator and a support frame made of pipes. Air to the fan is sucked into the air inlet placed on the side of the fan wheel that is facing towards the back of the operator. This means that there must be a gap between the fan inlet and the back of the operator of 5–10 centimeters to guarantee that enough air can pass to the inlet. On the other side of the fan wheel is the engine that power the fan and the starting device for the engine placed together with all the other components in the leaf blower. The starting device is placed on an extension of the axle that drives the fan wheel which means that the position for the starting device will be far away from the back of the operator when the leaf blower is in its right position on the back of the operator. This solution work but the centre of gravity for the tool will be placed at quite a long distance from the operator. This distance makes the leaf blower heavy and complicated to handle.

A starting device placed outside the engine will also be impossible for the operator to reach when the leaf blower is in its right position on the back of the operator. This makes it impossible for the operator to start the engine without removing the leaf blower from its position on the back of the operator. This means that the operator must take the tool down and start it and, when the tool is running, put it in the right position again. These steps are heavy for the operator.

The engine for a leaf blower of the described type will have an axle that in one direction are connected with the fan and in the other direction is connected to the starting device. This solution is expensive and complicated to manufacture.

The construction of leaf blower can therefor be improved so that the loads that the operator is exposed to are reduced.

The claimed invention that is described in this application reduces the distance between the centre of gravity for the tool and the back of the operator and makes it easier for the operator to reach the starting handle that controls the starting device considerably.

The starting device, that is of the conventional type with a handle in the end of a rope attached to the rope wheel. The rope wheel is connected to the axle from the engine. When the engine shall be started does the operator grab the starting handle and pull it so that the axle is rotated and the engine started. The rope is then winded on the rope wheel by a spring that rotates the rope wheel backwards.

The starting device that is defined by the claims differs from the on known in the prior art in such a way that it is placed on the side of the fan wheel that is facing towards the operator when the leaf blower is in its right position. The starting device is placed in the hub of the fan wheel in the spacing that is created inside the ring shaped fan outlet since the outlet is wider that the fan wheel.

The above-described solution moves the centre of gravity for the leaf blower closer to the back of the operator since several components is placed closer to the back of the operator.

This new position for the starting device makes it possible to lead the rope out from the starting device and to the side of the leaf blower where the operator can reach the handle without having to remove the tool from its position of the back of the operator. The position for the handle can be changed since the rope and the handle can be positioned in any radial direction from the starting device. Suitable position is so that the operator can reach the handle by his right hand.

Another advantage with this type of starting device is that the shaft that connects the engine with the fan and the starting device don't has to extend in two directions from the engine.

One embodiment of the claimed invention is illustrated in the following figures.

FIG. 1. Shows the starting device and the fan seen from the side that is facing towards the back of the operator.

Figure 2:
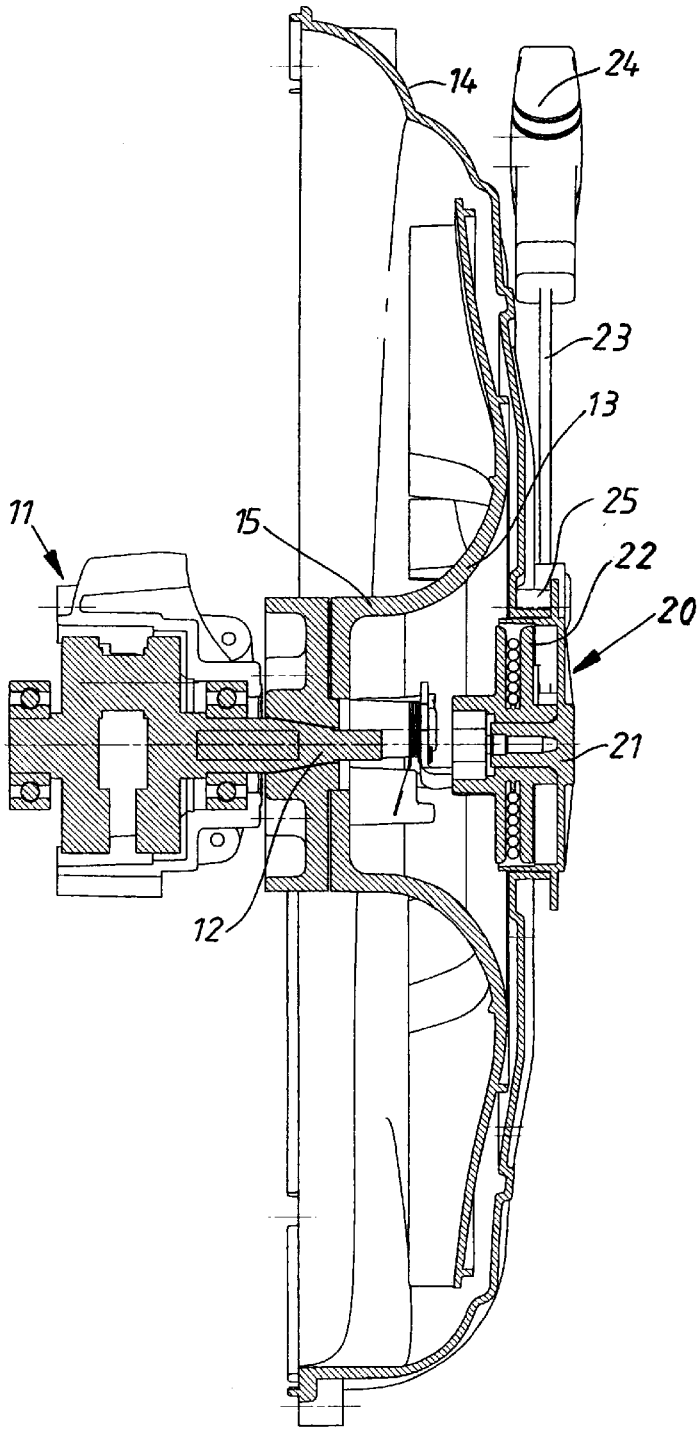

FIG. 2. Shows a cross section through the centre of the fan and the starting device for the leaf blower.

Figure 3:
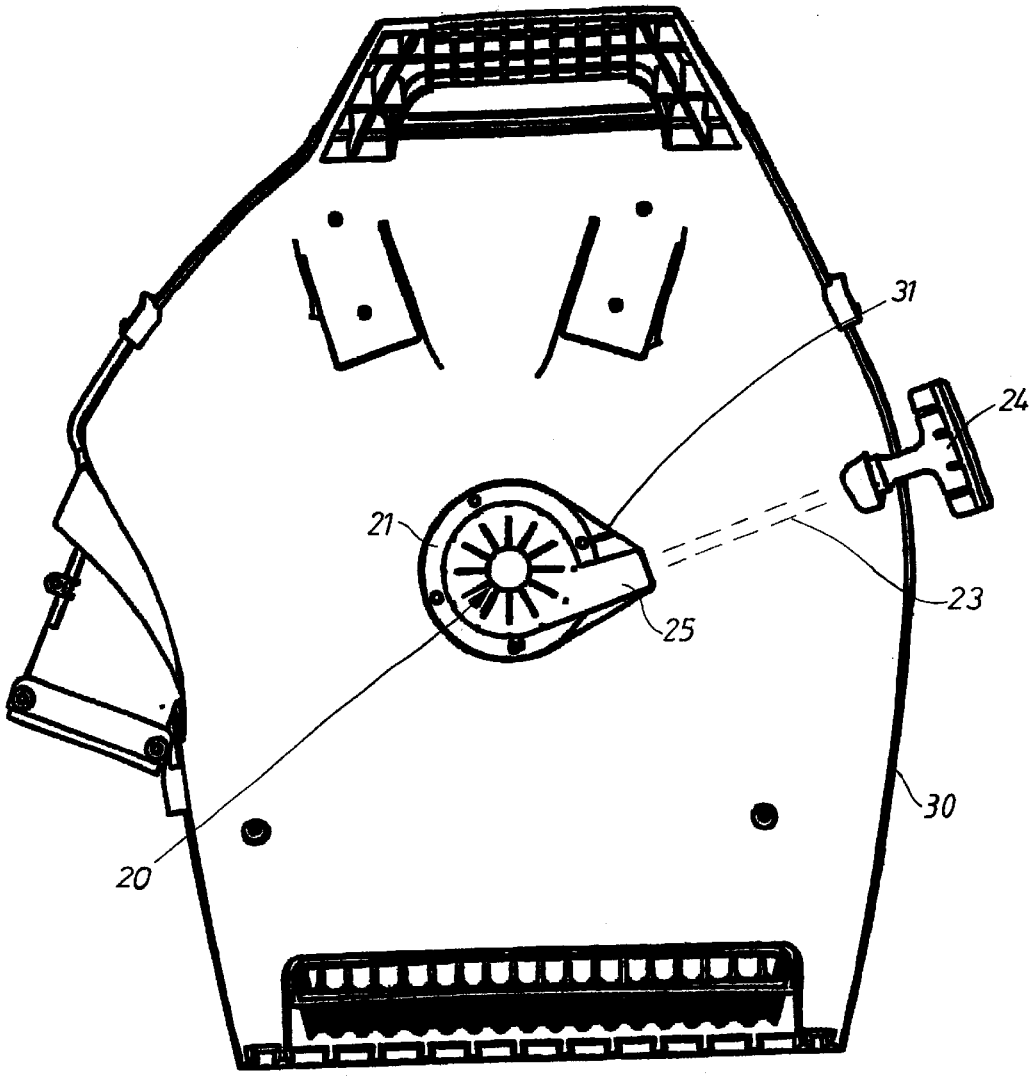

FIG. 3. Shows the side a leaf blower with a covering casing that is turned towards the back of the operator.

In FIG. 1 is a cross section of the starting device and the fan illustrated. An engine with a shaft 12 is connected to a fan wheel 13. The fan wheel 13 is surrounded by a ring shaped fan outlet 14 placed around the periphery of the fan wheel 13. The ring shaped fan outlet 14 is provided with a couple of fastening means 16 so that the described components can be attached to the supporting frame for the tool. The fan wheel 13 is shaped so that a starting device 20 is placed inside a hub 15 to the fan wheel 13.

The starting device 20 includes a rope wheel 22 placed inside a surrounding casing 21. The starting device 20 is connected to the shaft 12 on the opposite side of the fan wheel 13 compared to the engine 11. The starting device 20 also includes a starting rope 23 that are winded on the rope wheel 22 and a starting handle 24 attached to the starting rope 23. To start the engine 11 is the starting handle 24 pulled outwards so the starting rope 23 rotates the shaft 12 and the engine 11 is started. The starting rope 23 is then winded on the rope wheel 22 by a not illustrated spring that rotates the rope wheel 23 backwards. The starting device 20 also has a rope-guiding device 25 that the starting rope 23 is led through. The handle 24 is then placed close to the periphery of the ring shaped fan outlet 14 so that it is reachable for the operator when the leaf blower is placed on the back of the operator.

In FIG. 3 is a leaf blower provided with a surrounding casing 30 illustrated. In order to make it easy for the operator to repair the starting device 20 is the casing 30 provided with an opening 31 placed close to the operator on the side of the casing 30 that is facing towards the back of the operator when the leaf blower is in its right position of the back of the operator.

The starting rope 23 pass through the casing 30 and is placed so that the starting handle 24 is reachable for the operator when the leaf blower is placed on the back of the operator.

What is claimed is:

1. Arrangement in a combustion engine powered leaf blower that is carried on the back of an operator comprising a fan wheel (13) and an engine (11), characterised in that a starting device (20) for the engine (11) is placed on the side of the fan wheel (13) that is facing towards the back of the operator when the leaf blower is in its right position on the back of the operator.

2. Arrangement according to claim 1, characterised in that the starting device (20) is placed in a hub (15) to the fan wheel (13).

3. Arrangement according to claim 1 or 2, characterised in that the fan wheel (13) is surrounded by a ring shaped fan outlet (14) and shaped so that the starting device (20) is located within the front edge of the ring shaped fan outlet (14).

4. Arrangement according to any of the previous claims, characterised in that the starting device (20) is acting on a shaft (12) that connects the engine (11) to the fan wheel (13).

5. Arrangement according to any of the previous claims, characterised in that he starting device (20) comprises a starting rope (23) that is winded on a rope wheel (22) and starting handle (24) in the end of the starting rope (23).

6. Arrangement according to claim 5, characterised in that the starting device (20) is mounted so that the starting rope (23) and the starting handle (24) is pointing in a radial direction outwards from the shaft (12) and that the starting rope (23) is led via a rope guiding mean (25) to any of the different sides of the leaf blower.

7. Arrangement according to claim 5 or 6, characterised in that the starting rope (23) and the starting handle (24) is placed so that the operator can reach the starting handle (24) when the leaf blower is in the right position on the back of the operator.

* * * * *

UNITED STATES PATENT AND TRADEMARK OFFICE

CERTIFICATE OF CORRECTION

PATENT NO. : 6,679,218 B2
DATED : January 20, 2004
INVENTOR(S) : Marcus Kragner et al.

It is certified that error appears in the above-identified patent and that said Letters Patent is hereby corrected as shown below:

Column 4,
Line 5, please delete “he”, and insert therefor -- the --.

Signed and Sealed this

Twentieth Day of July, 2004

JON W. DUDAS
*Acting Director of the United States Patent and Trademark Office*